US007748789B2

(12) United States Patent
Freeburn

(10) Patent No.: US 7,748,789 B2
(45) Date of Patent: Jul. 6, 2010

(54) PAVEMENT PROFILER

(76) Inventor: Charles W. Freeburn, 902 E. Toledo, Fremont, IN (US) 46737

( * ) Notice: Subject to any disclaimer, the term of this patent is extended or adjusted under 35 U.S.C. 154(b) by 563 days.

(21) Appl. No.: 11/753,834

(22) Filed: May 25, 2007

(65) Prior Publication Data

US 2008/0292399 A1 Nov. 27, 2008

(51) Int. Cl.
*E01C 23/09* (2006.01)

(52) U.S. Cl. ..... 299/39.5; 404/94; 299/39.6

(58) Field of Classification Search ..... 299/39.5, 299/39.6, 39.4, 39.1; 404/90, 94
See application file for complete search history.

(56) References Cited

U.S. PATENT DOCUMENTS

| | | | | |
|---|---|---|---|---|
| 1,630,422 | A | | 5/1927 | Gillespie |
| 3,767,262 | A | | 10/1973 | Pentith |
| 3,888,542 | A | | 6/1975 | Gowler |
| 4,154,481 | A | | 5/1979 | Heckenhauer et al. |
| 4,256,344 | A | | 3/1981 | Hatcher |
| 4,333,686 | A | * | 6/1982 | Arnswald ..... 299/39.6 |
| 4,387,929 | A | | 6/1983 | Wirtgen |
| 4,458,949 | A | | 7/1984 | Jury |
| 4,473,319 | A | | 9/1984 | Spangler |
| 4,516,808 | A | | 5/1985 | Staab et al. |
| 4,714,374 | A | * | 12/1987 | Mihara ..... 404/91 |
| 4,808,026 | A | * | 2/1989 | Clarke et al. ..... 404/90 |
| 4,878,713 | A | | 11/1989 | Zanetis |
| 5,203,615 | A | | 4/1993 | Zanetis et al. |
| 5,354,146 | A | | 10/1994 | O'Konek |
| 5,378,081 | A | | 1/1995 | Swisher |
| 6,116,699 | A | | 9/2000 | Kaczmarski et al. |
| 6,176,551 | B1 | | 1/2001 | Page |
| 6,227,620 | B1 | | 5/2001 | Page |
| 6,499,809 | B1 | | 12/2002 | O'Konek |
| 6,520,593 | B2 | | 2/2003 | Dvorak et al. |
| 6,682,261 | B1 | | 1/2004 | Karamihas et al. |
| 7,029,072 | B1 | | 4/2006 | Murray et al. |
| 7,029,370 | B2 | | 4/2006 | Cochran et al. |

* cited by examiner

*Primary Examiner*—John Kreck
(74) *Attorney, Agent, or Firm*—Brinks Hofer Gilson & Lione

(57) ABSTRACT

A pavement profiler having a grinding element within an enclosure for smoothing an existing road surface includes a transporter having a frame supported on a set of wheels with the enclosure situated between the forward and rearward wheels of the transporter. Positioning mechanisms coupled between the transporter frame and the grinding element enclosure positions the grinding element relative to the pavement surface. The positioning mechanisms includes a front support and a front lift mechanism, and a rear support and a rear lift mechanism. The rear support has vertically extending tracks fixed to the transport frame, and vertically extending rails movable relative to the tracks, the rails being coupled to the rear lift mechanism. Forwardly projecting flanges fixed to the rails have a pivot defining element. Rearwardly projecting flanges from the enclosure are coupled to the pivot defining element to permit the enclosure to pitch relative to the transport frame. A slot is provided in one of flanges receiving a pin from an adjacent flange so that the slot and pin limit the range of pitching motion of the grinding element enclosure.

22 Claims, 12 Drawing Sheets

PAVEMENT PROFILER

BACKGROUND OF THE INVENTION

The present invention relates to equipment for modifying the surface of an existing road, and in particular to equipment for smoothing areas of existing pavement by removing bumps and other upward projections.

A variety of apparatus is known in the prior art designed to remove bumps and other irregularities on the surface of a road, runway, taxiway, or other stretch of pavement. For example, Gillespie, U.S. Pat. No. 1,630,422, discloses a road planning device having a rotary cutting element powered by an engine mounted in a generally rectangular frame designed to be towed behind a tractor. Four supports for the frame contact the underlying pavement and are longitudinally adjustable to accommodate differences in the initial smoothness of the pavement. Hatcher, U.S. Pat. No. 4,256,344, discloses a concrete surfacing machine having a carriage with front and rear wheels at its ends which support the carriage for movement along a surface to be worked. Mounted on this carriage between the wheels is a concrete surface smoothing or planing machine having a motor driven rotary cylindrical cutting drum. The carriage has a propulsion unit for propelling the carriage along the surface that includes a drive system for the carriage wheels for use on relatively level surfaces and a winch drive for use on slopes. Both the vertical and horizontal position of the wheels are adjustable relative to the cutting drum Staab et al. U.S. Pat. No. 4,516,808, discloses a pavement grinding apparatus that includes a main frame having a plurality of wheels supporting the main frame on the paved surface. Means are provided for propelling the main frame across the paved surface in a desired direction. A sub-frame is disposed within the main frame. At least one movable connector attaches the main frame to the sub-frame for imparting substantially horizontal, longitudinal and/or lateral, forces from the main frame to the sub-frame while allowing substantially free vertical motion of the sub-frame relative to the main frame. A grinding unit is mounted on the sub-frame for grinding a paved surface at a selected grinding depth. At least one grinding unit roller is mounted on the sub-frame for supporting it at a selected elevation with respect to the paved surface. The grinding unit roller operates to control the grinding depth of the grinding unit independently of the position of the main frame. A boom is fixed to the sub-frame and extends forwardly therefrom in the direction of travel of the main frame. At least one boom wheel is mounted on the forward end of the boom for rolling on the paved surface and for supporting the boom thereon. A hydraulic mounting system hydrostatically mounts the front and rear rollers on the sub-frame so that the elevation of the front and rear rollers with respect to the sub-frame may be adjusted hydraulically. The front and rear rollers are hydraulically interconnected to equalize the vertical load carried by each roller so that the vertical movement of the boom and boom wheel will cause the sub-frame to rotate or pitch about an axis proximate to the grinding head so that the grinding depth of the grinding head will remain substantially constant in the presence of vertical motion of the boom and boom wheel.

O'Konek, U.S. Pat. No. 6,499,809 discloses a pavement grinder that includes a cutting device having a separate grinding carriage with carriage drive wheels. A rotating arbor hangs from underneath the carriage. A support device supports the grinding carriage from above. A first motor drives the arbor in a first direction, and a second motor drives the carriage drive wheels in an opposite direction. The carriage drive wheels remain in contact with the pavement when the grinding carriage is in a raised position. A depth controller is mounted on the carriage for raising and lowering the carriage relative to the carriage drive wheels. Additional road cutting machines are disclosed in Pentith, U.S. Pat. No. 3,767,262; Gowler, U.S. Pat. No. 3,888,542; and Heckenhauer et al. U.S. Pat. No. 4,154,481.

Despite the various features and benefits of the structures in the forgoing disclosures, there remains a need for a pavement grinding apparatus designed to remove bumps and other irregularities from the surface of a road, runway, taxiway, or other pavement that provides for a plurality of modes of operation and control of the grinding element in relation to the pavement surface to achieve the desired pavement profile.

SUMMARY OF THE INVENTION

These several needs may be satisfied by a pavement profiler that can be used to modify the surface contour of existing pavement. The pavement profiler can include a transporter having a frame, a forward and a rearward set of wheels supporting the transporter frame above an existing pavement surface, and a motor coupled to the wheels for propulsion of the transporter relative to the pavement surface. The transporter frame can be of sufficient length to permit additional equipment to be situated between the forward and rearward wheels of the transporter. The pavement profiler generally includes a grinding element adapted for smoothing the existing pavement surface, an enclosure generally enclosing the grinding element except on a downward facing side confronting the pavement surface, and a source of power coupled to the frame for powering the grinding element. The grinding element can take the form of a generally cylindrical drum having a plurality of cutting elements disbursed around and along the surface of the drum. The drum can be mounted to the enclosure so that the axis of rotation of the cylindrical surface is situated horizontally. A positioning mechanism can be coupled between the transporter frame and the grinding element enclosure for positioning the grinding element relative to the pavement surface.

The positioning mechanism can have a front support for the enclosure and a front lift mechanism coupled between the transporter frame and the front support for vertically adjusting the position of the front support relative to the transporter frame. The positioning mechanism can also have a rear support for the enclosure and a rear lift mechanism coupled between the transport frame and the rear support for vertically adjusting the position of the rear support relative to the transporter frame. The rear support can take the form of vertically extending tracks fixed to the transport frame, and vertically extending rails movable relative to the tracks. The rails can be coupled to the rear lift mechanism.

The positioning mechanism can also have forwardly projecting flanges fixed to the rails, each flange having a pivot defining element coupled to the grinding element enclosure to permit the enclosure to pitch relative to the transport frame. Rearwardly projecting flanges can be coupled to the grinding element enclosure and situated adjacent to the forwardly projecting flanges so that the pivot defining element can pivotally couple the forwardly and rearwardly projecting flanges relative to each other. A slot can be provided in one of flanges receiving a pin from an adjacent flange so that the slot and pin limit the range of pitching motion of the grinding element enclosure.

The positioning mechanism can also have a first stop coupled to the transporter frame and a second stop coupled to the vertically extending rails to limit downward movement of the rear support relative to the transporter frame. At least one of the first and second stops can be adjustable to selectively position the limit of downward movement of the rear support.

The positioning mechanism can also have at least one vertical track fixed to a surface of the grinding element enclosure, with a wheel adapted for contacting the pavement surface coupled to the track. A jacking element can be coupled between the wheel and grinding element enclosure for adjusting the vertical position of the wheel in relation to the open downward facing side of the enclosure to limit downward movement of the enclosure relative to the pavement surface. Such vertical tracks can be positioned near the outside edges of both the forward and rearward surfaces of the grinding element enclosure.

The positioning mechanism can also have a horizontal track fixed to a top surface of the grinding element enclosure. A track engaging slide, which can include a pivot element, can be coupled to the horizontal track and to the front lift mechanism. A lateral shifting mechanism can be coupled between one of the slide and the grinding element enclosure for shifting the horizontal track and enclosure laterally relative to the front lift mechanism. The lateral movement can be facilitated by providing the rear support for the grinding element enclosure with a lower flange and an upper flange that are vertically spaced from each other. A plate can be fixed to the grinding element enclosure, with the upper and lower flanges capturing the plate and defining a track for lateral movement of the plate and enclosure relative to the transport frame.

The positioning mechanism can also have a beam projecting forward from the grinding element enclosure, the beam supporting a floater having two wheels adapted to contact the pavement surface. A coupling can be supplied for adjustably coupling the floater to the beam to selectively position the wheels of the floater relative to the open downward facing side of the enclosure. The wheels can also be adjustably positioned forward and rearward with respect to each other and with respect to a central pivot point of the beam, which can provide for a pitching deflection of the floater relative to the beam, to provide the desired about of lead for the profiling operation.

Other features of the present invention and the corresponding advantages of those features will be come apparent from the following discussion of the preferred embodiments of the present invention, exemplifying the best mode of practicing the present invention, which is illustrated in the accompanying drawings. The components in the figures are not necessarily to scale, emphasis instead being placed upon illustrating the principles of the invention. Certain common elements, such as hoses, wiring, etc., have been omitted to permit clear illustration of central elements of the invention. Moreover, in the figures, like referenced numerals designate corresponding parts throughout the different views.

DESCRIPTION OF PREFERRED EMBODIMENTS

Figure 1:
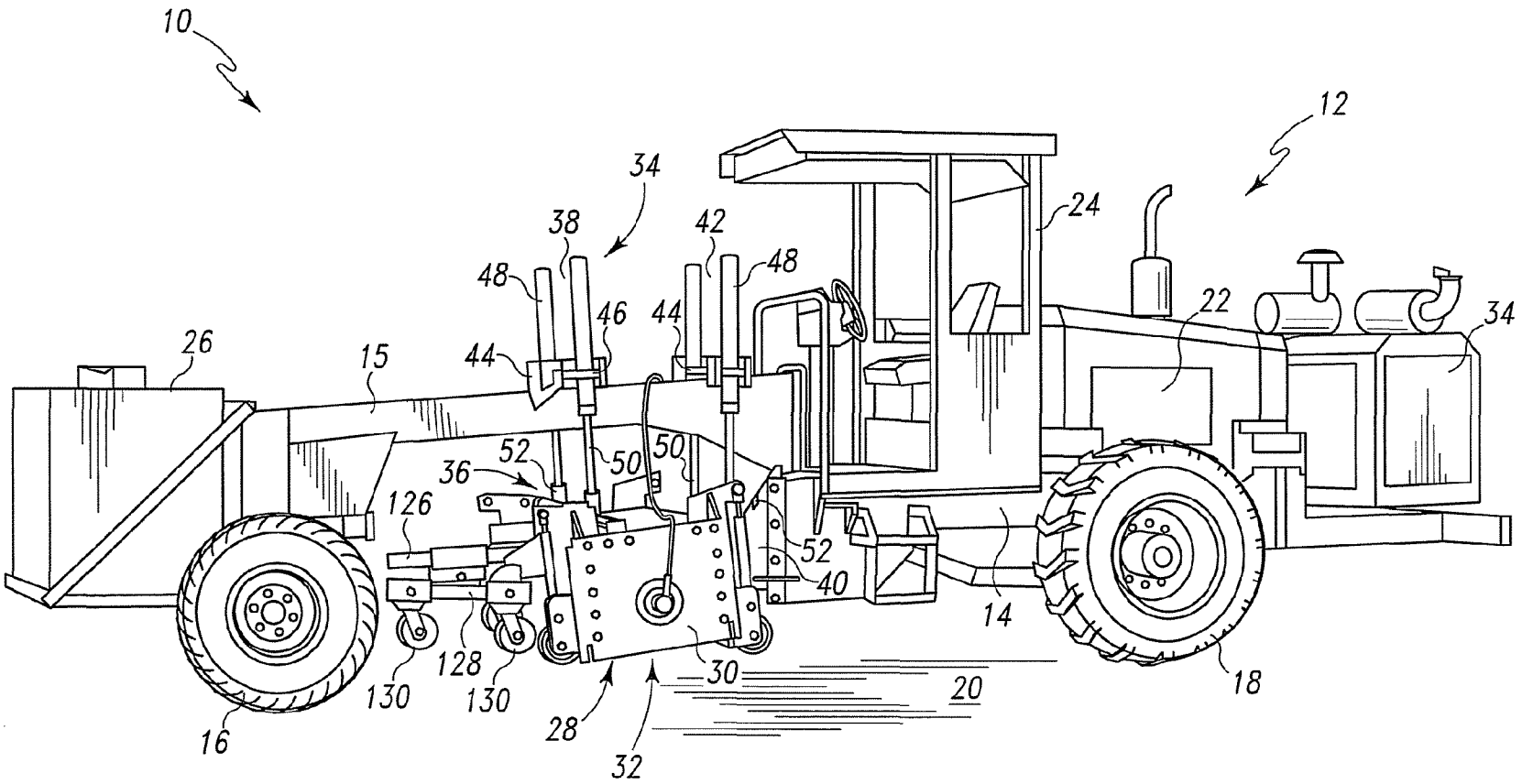
FIG. 1 is a side view of a road profiler embodying the present invention.

A pavement profiler 10 is shown in FIG. 1 that can be used to modify the surface contour of existing pavement. The pavement profiler 10 can include a transporter 12 having a frame 14. A forward set of wheels 16 and a rearward set of wheels 18 support the transporter frame 14 above an existing pavement surface 20. A motor 22 is coupled to the wheels 18 for propulsion of the transporter relative to the pavement surface 20. The transporter frame 14 can have a gooseneck section 15 of sufficient length to permit additional equipment to be situated between the forward wheels 16 and rearward wheels 18. The direction and speed of the pavement profiler 10 can be controlled in a conventional manner by controls situated in cab 24. A tank 26 for containing a dust inhibiting fluid, such as water, can be mounted at the front of the profiler 10.

The pavement profiler 10 generally includes a grinding element 28 adapted for smoothing the existing pavement surface 20. An enclosure 30 generally encloses the grinding element 28 except on a downward facing side 32 confronting the pavement surface 20. A source of power 34, such as a hydraulic pump, is coupled to the frame 14 for powering the grinding element 28 by way of a suitable control located in cab 24. The grinding element 28 can take several forms including the form of a generally cylindrical drum having a plurality of cutting elements disbursed around and along the surface of the drum. The drum can be mounted to the enclosure 30 so that the axis of rotation of the cylindrical surface is situated generally horizontally. The grinding element 28 can also take the form of at least one disk having a plurality of cutting elements disbursed over a lower substantially planar surface of the disk. The disk(s) can be mounted to the enclosure 30 so that the axes of rotation of the disk(s) are situated perpendicularly to the downward facing side 32.

Figure 2:
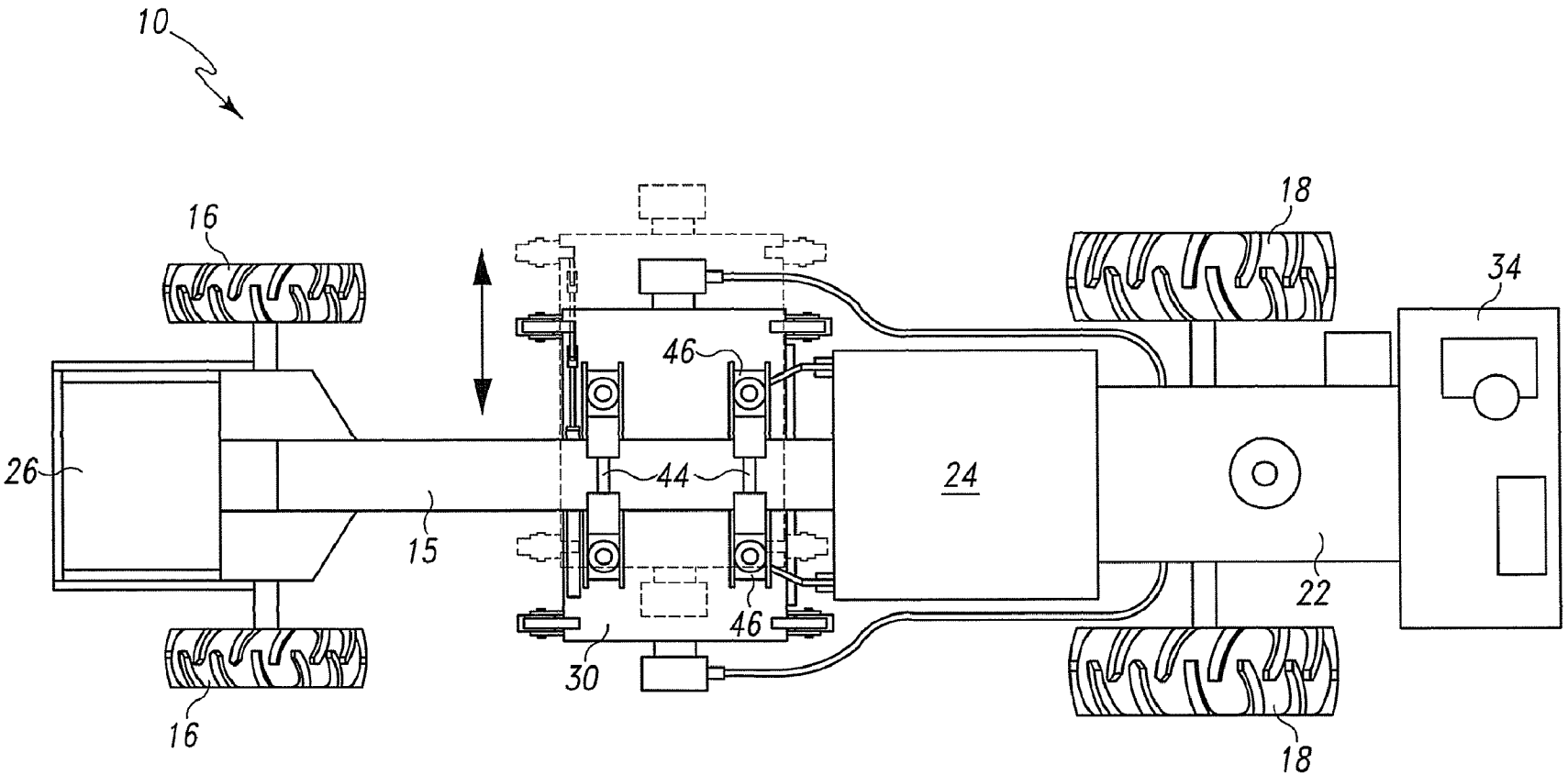
FIG. 2 is a top plan view of the road profiler shown in FIG. 1, with the grinding element enclosure centrally positioned and a right lateral position shown in phantom.
Figure 3:
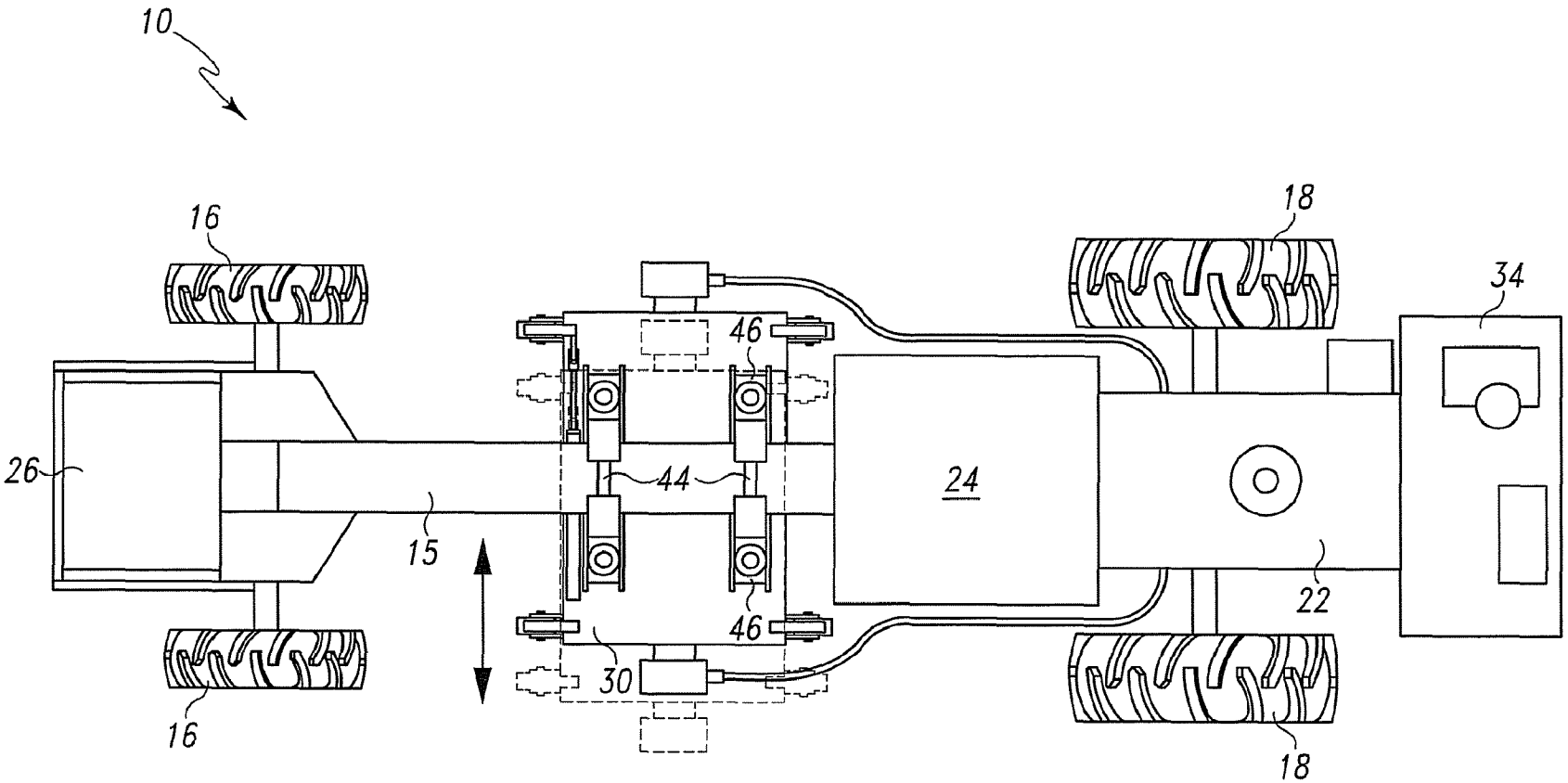
FIG. 3 is a top plan view of the road profiler shown in FIG. 1, with the grinding element enclosure centrally positioned and a left lateral position shown in phantom.

A positioning mechanism 34 can be coupled between the transporter frame 14 and the grinding element enclosure 30 for positioning the grinding element 28 relative to the pavement surface 20. The positioning mechanism 34 can have a front support 36 for the enclosure 30 and a front lift mechanism 38 coupled between the transporter frame 14 and the front support 36. The front lift mechanism 38 can vertically adjust the position of the front support 36 relative to the transporter frame 14. The positioning mechanism 34 can also have a rear support 40 for the enclosure 30 and a rear lift mechanism 42 coupled between the transport frame 14 and the rear support 40. The rear lift mechanism 42 can vertically adjust the position of the rear support 40 relative to the transporter frame 14. The front lift mechanism 38 and the rear lift mechanism 42 can be coupled to the power source 34 and can be independently controlled by suitable controls in the cab 24 so that the vertical position front support 36 and rear support 40 can be individually located as shown, for example, in FIGS. 4 and 5. The lift mechanisms 38 and 42 can also include hydraulic cylinders 48 coupled to the pivotal supports so that a piston rod 50 extends downward to a lower end 52 that is coupled to one of the front support 36 or the rear support 40. The front lift mechanism 38 and the rear lift mechanism 42 can each take the form of a yoke 44 supported on the gooseneck 15, the yoke 44 extending laterally outward to pivotal supports 46 as shown, for example, in FIGS. 2 and 3.

Figure 6:
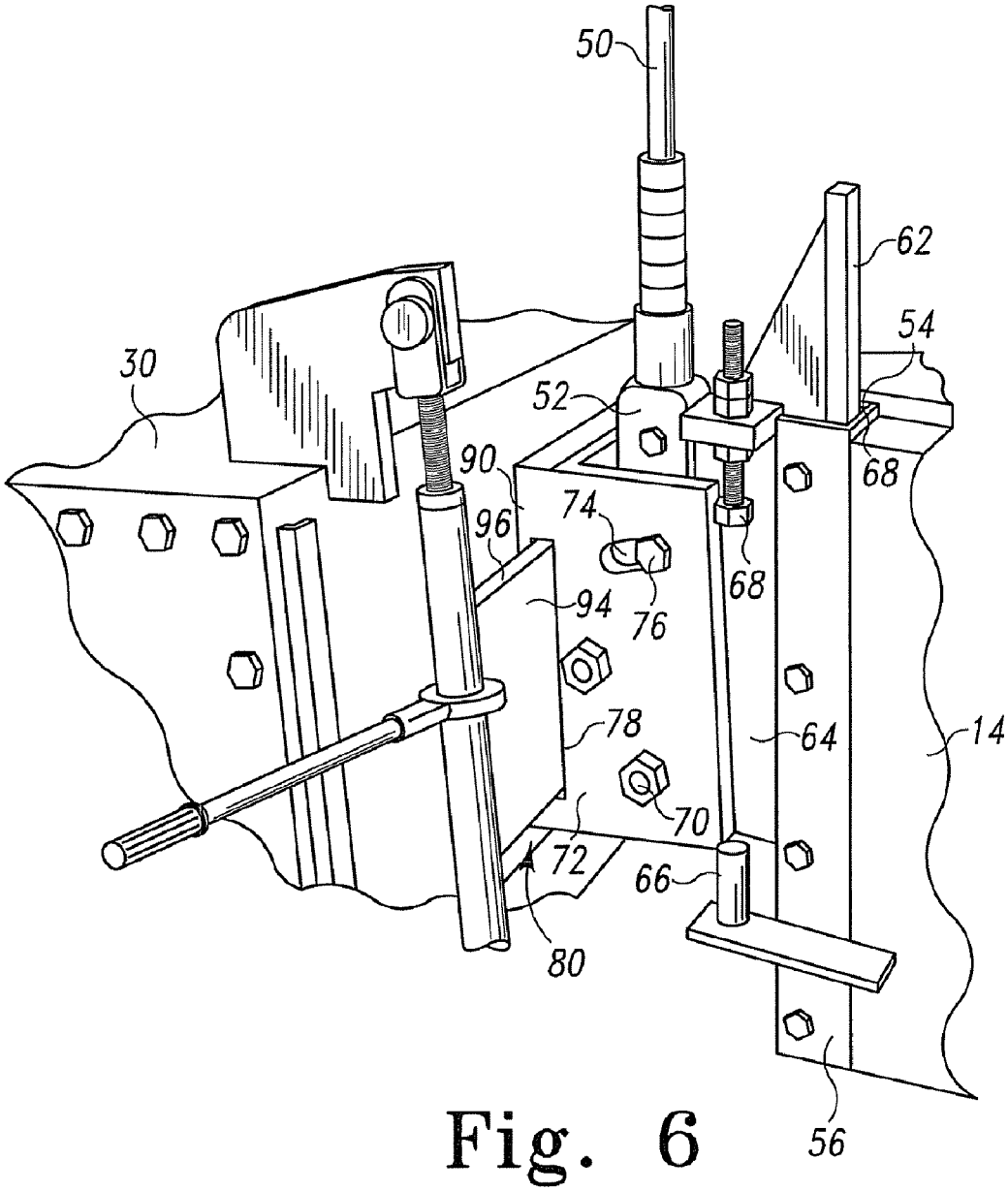
FIG. 6 is a perspective view of the left rear support mechanism for the grinding element enclosure.
Figure 7:
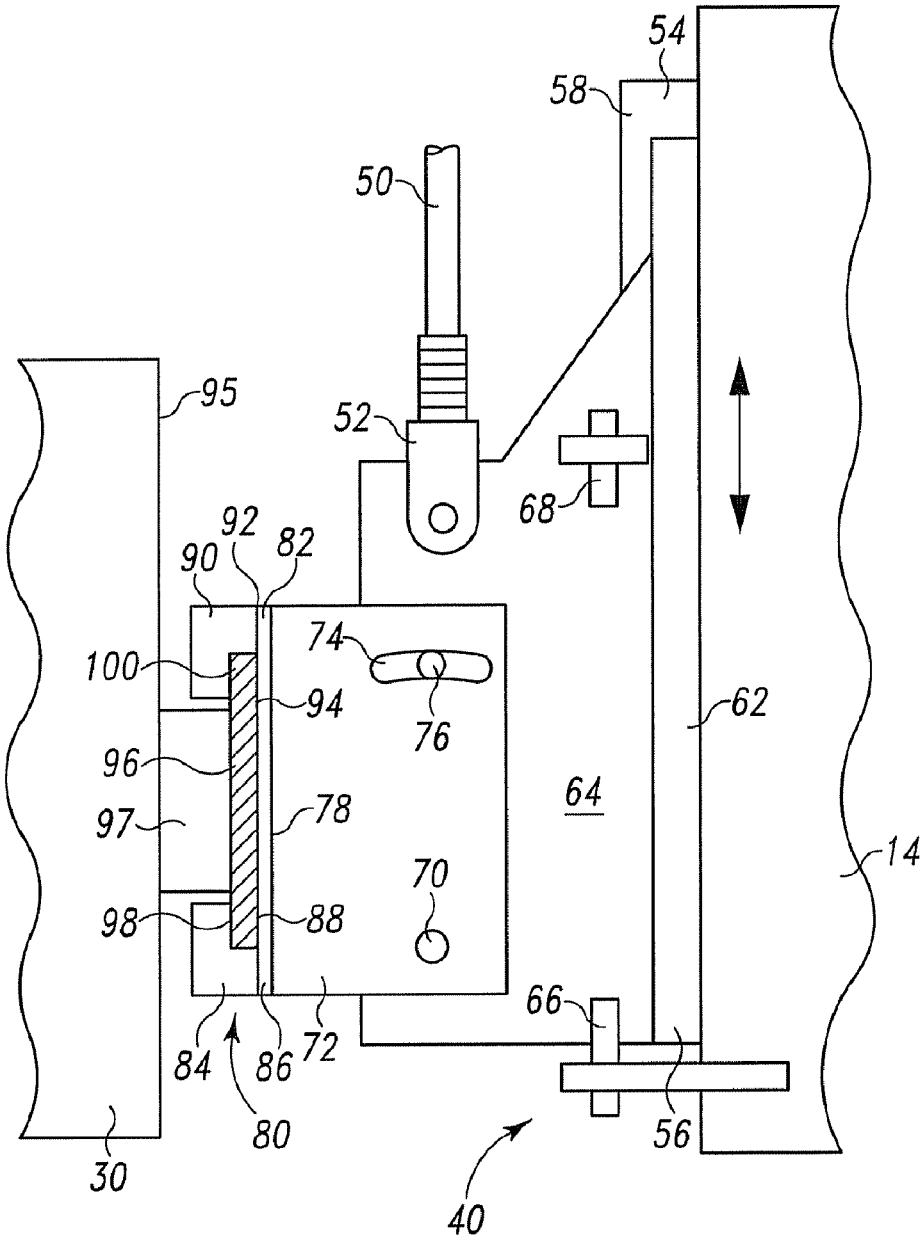
FIG. 7 is a side elevation view of the left rear support mechanism for the grinding element enclosure.
Figure 8:
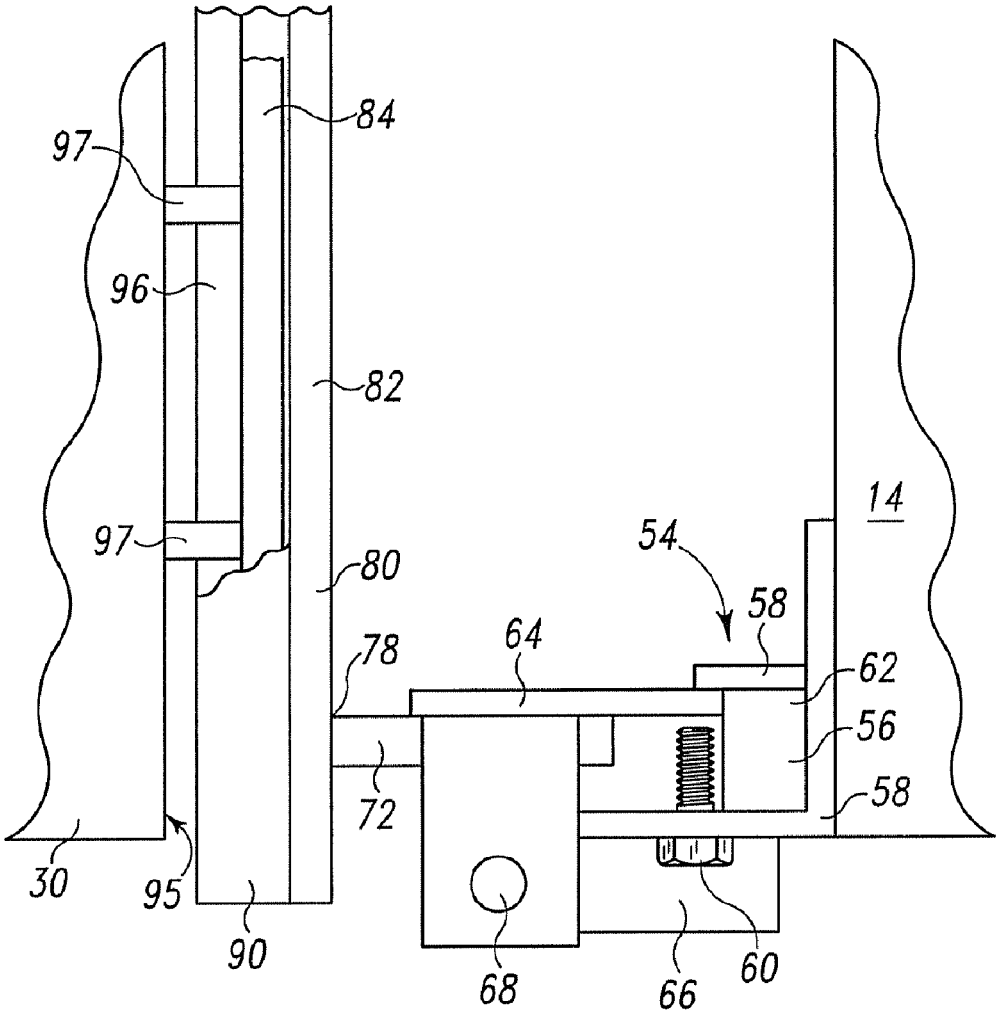
FIG. 8 is a plan view of the left portion of the rear support mechanism.

The rear support 40 can take the form of vertically extending tracks 54 fixed to the transport frame 14, and vertically extending rails 56 movable relative to the tracks 54 as shown in FIGS. 6 to 8. Each track 54 can take the form of a pair of forwardly projecting parallel walls 58 spaced from each other by a distance sufficient to receive one of the rails 56. The rails 56 can be captured in the tracks 54 by a plurality of projections 60 extending from one of the parallel walls 58 toward the other wall defining the same track 54. The rails 56 can take the form of a head portion 62 that is received in the track 54. A forwardly projecting flange 64 can be fixed to the rail head portion 62. Each of the forwardly projecting flanges 64 can be coupled to a lower end 52 of a piston rod 50 or equivalent structure of the rear lift mechanism 42. Thus vertical movement of the rear lift mechanism is translated into vertical movement of the rail 56 relative to the track 54 fixed to the transport frame. A first stop 66 and be coupled to the transporter frame 14 in proximity to the track 54. A second stop 68 can be coupled to the vertically extending rail 56 to limit downward movement of the rear support 40 relative to the transporter frame 14. At least one of the first stop 66 and the second stop 68 can be adjustable to selectively position the limit of downward movement of the rear support 40.

Each of the forwardly projecting flanges 64 that are fixed to the rails 56 can have a pivot defining element 70 coupled to the grinding element enclosure 30 to permit the enclosure 30 to pitch relative to the transport frame 14. Rearwardly projecting flanges 72 can be coupled to the grinding element enclosure 30 and situated adjacent to the forwardly projecting flanges 64 so that the pivot defining element 70 can pivotally couple the flanges 64 and 72 relative to each other. A slot 74 can be provided in one of flanges 64 or 72 that receives a projecting element such as a pin 76 from an adjacent flange 72 or 64 so that the slot 74 and pin 76 limit the range of pitching motion of the grinding element enclosure 30 relative to the rear support 40 as shown, for example in FIGS. 4 and 5.

A forward edge 78 of the rearwardly projecting flanges 72 can be fixed to a horizontal track defining member 80. The horizontal track defining member 80 can take the form of a plate 82 fixed to the flanges 72. A first channel-defining member 84 can be coupled to a lower edge 86 of the plate 82 to define a lateral channel 88 between the plate 82 and the channel-defining member 84. A retaining member 90 can be coupled to an upper edge 92 of the plate 82 to define a lateral slot 94 between the plate 82 and the retaining member 90. A track engaging member 96, which can be in the form of a plate supported on webs 97, can be fixed to a rear surface 95 of the grinding element enclosure 30. The track engaging member 96 can have lower flange 98 and upper flange 100 that are dimensioned to be received in the lateral channel 88 and lateral slot 94, respectively, so that the grinding element enclosure 30 can move laterally with respect to the rear support 40, as shown, for example, in FIGS. 2 and 3.

Figure 9A:
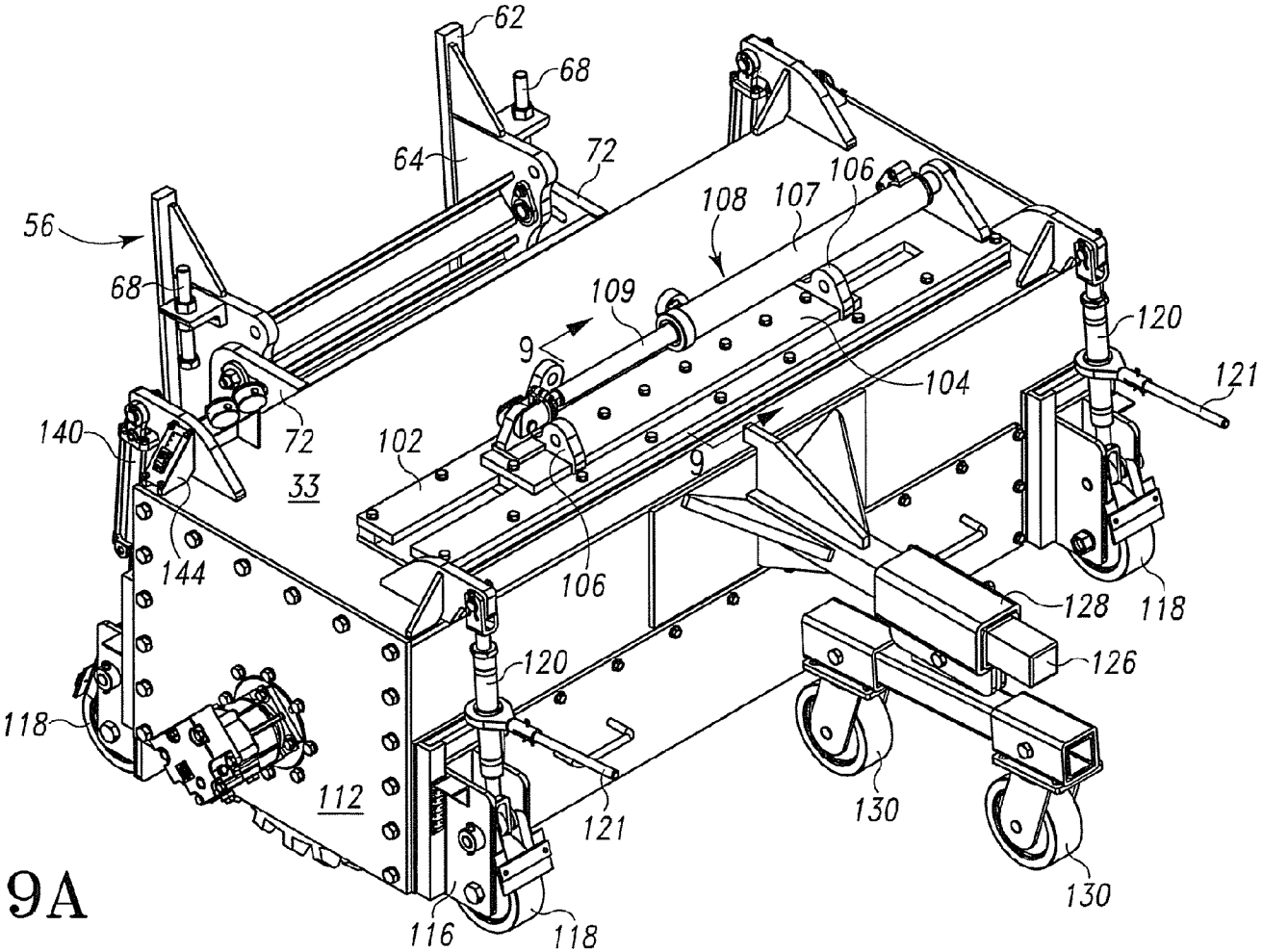
FIG. 9A is a perspective view of the grinding element enclosure including the track and drive of the front support mechanism permitting lateral displacement of the grinding element enclosure.
Figure 9B:
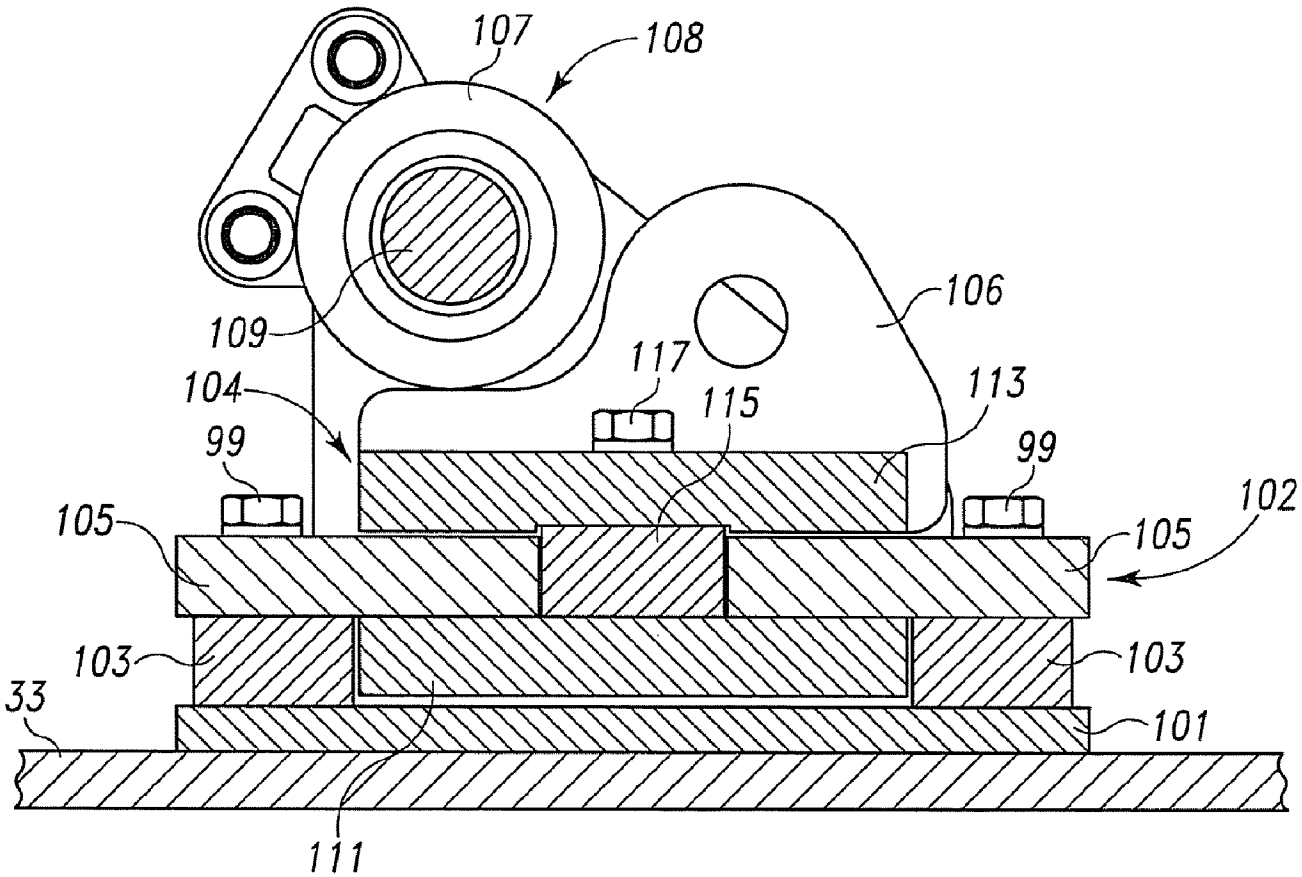
FIG. 9B is a sectional view of the track and drive of the front support mechanism taken along line 9-9 as shown in FIG. 9A.

The positioning mechanism 34 can also have a horizontal track 102 fixed to a top surface 33 of the grinding element enclosure 30 as shown in FIGS. 9A and 9B. The front support 36 can include a track engaging slide 104 to which pivot elements 106 are fixed. The track engaging slide 104 can be captured by the horizontal track 102 and coupled to the front lift mechanism 38. In particular, the horizontal track 102 can include a base plate 101 that can be in contact with the top surface 33 of the grinding element enclosure 30 as shown in FIG. 9B. The horizontal track 102 can also include front and rear spacer elements 103 and inwardly directed flanges 105. The flanges 105, spacer elements 103 and base plate 101 can be secured to the top surface 33 of the grinding element enclosure by suitable fasteners 99. The slide 104 can take the form of a lower plate 111 situated between the spacer elements 103 and below the inwardly directed flanges 105. The slide 104 can also include an upper plate 113 situated above the inwardly directed flanges 105. A bridge element 115 can be located between the two inwardly directed flanges 105 and coupled between the plates 111 and 113 by suitable fasteners 117. The lower plate 111 of the slide 104 is thereby captured by the inwardly directed flanges 105 of the horizontal track 102.

The pivot elements 106 can be fixed to the upper plate 113 of slide 104. The pivot elements 106 can be coupled to the ends 52 of the piston rods 50 that are coupled to the front support 36 as shown, for example, in FIGS. 4 and 5. Any lifting force applied by the piston rods ends 52 to the pivot elements 106 is transferred to the lower plate 111 of the slide 104 which is captured by the inwardly directed flanges 105 of the horizontal track 102. Thus, any lifting force applied by the piston rods 50 can be transferred to the top 33 of the grinding element enclosure 30 through the slide 104 and track 102. A lateral shifting mechanism 108, which can be in the form of a hydraulic cylinder 107 and piston 109, can be coupled between the track engaging slide 104 and the grinding element enclosure 30 or the horizontal track 102. The lateral shifting mechanism 108 can be used for shifting the horizontal track 102 and enclosure 30 laterally relative to the track engaging slide 104 and front lift mechanism 38 as shown, for example, in FIGS. 2 and 3. The lateral movement of the grinding element enclosure 30 relative to the frame 14 can be facilitated by providing a control within the cab 24 for controlling the power flowing from the power source 34 to the lateral shift mechanism 108. The lateral movement of the grinding element enclosure 30 relative to the frame 14 can be facilitated by providing another lateral shifting mechanism, not shown, adjacent to plate 82 and track engaging member 96 on the rear surface 95 of the grinding element enclosure 30 that is commonly controlled and powered along with the lateral shift mechanism 108.

Figure 10:
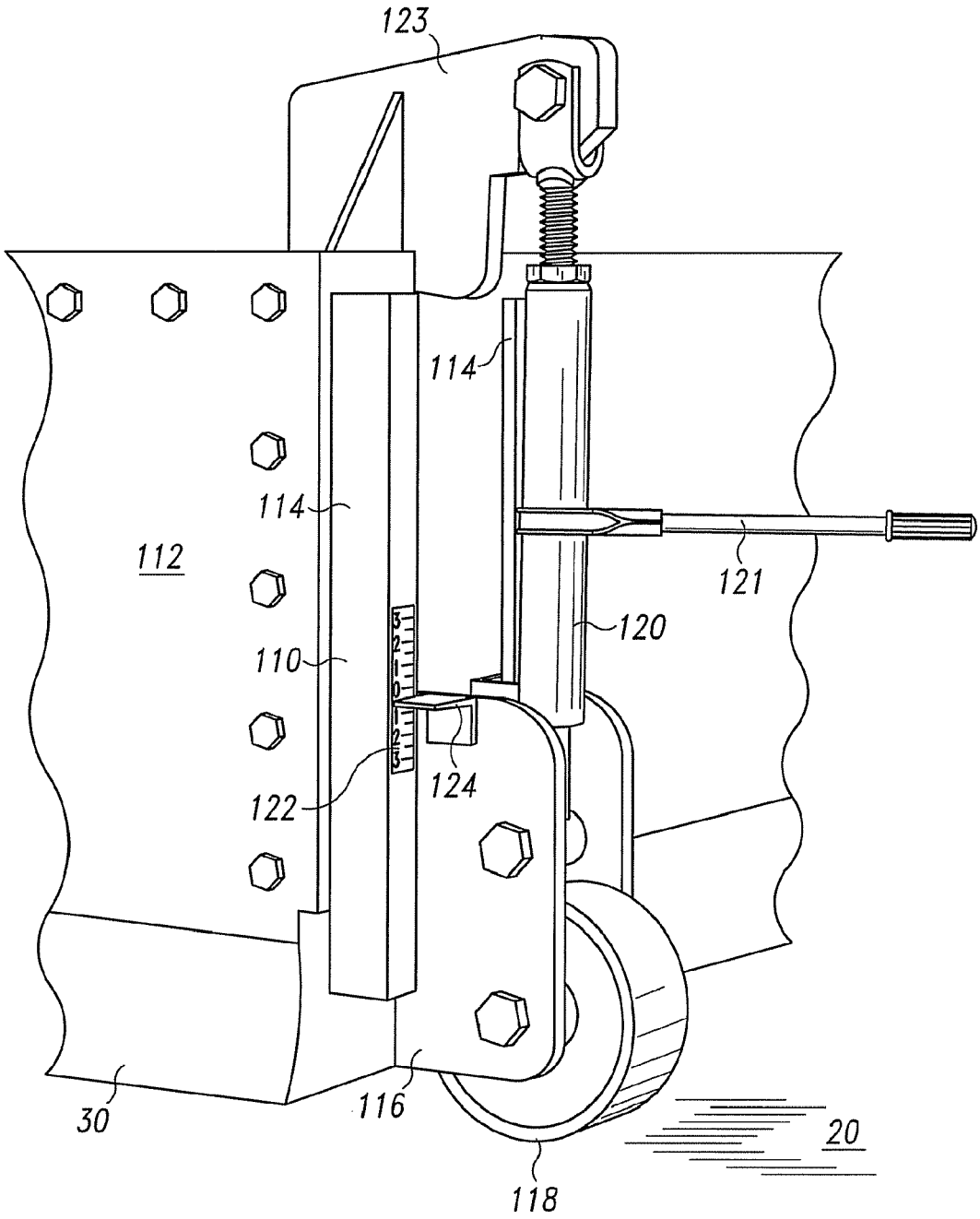
FIG. 10 is a perspective view of an adjustable limiter for limiting the downward movement of the grinding element enclosure relative to the pavement surface.

At least one vertical track 110 can be fixed to a front surface 112 of the grinding element enclosure 30 as shown in FIG. 10. At least one other similar vertical track 110 can be fixed to the rear surface 95 of the grinding element enclosure 30. Each track 110 can be in the form of a pair of L-shaped members 114 fixed to the enclosure 30 at a uniform spaced distance from each other. A wheel carriage 116 is coupled into the track 110 and a wheel 118 is coupled to the wheel carriage 116 for contacting the pavement surface 20. A jacking element 120, having handle 121, can be provided between the wheel carriage 116 and a support 123 on the enclosure 30 for adjusting the vertical position of the wheel carriage 116 in relation to the enclosure 30 to limit downward movement of the enclosure. A scale 122 can be provided adjacent to the track 110 and a pointer 124 can be provided on the wheel carriage 116 to facilitate accurate positioning of the carriage 116 relative to the enclosure 30. In the preferred embodiment, two vertical tracks 110 are fixed to the front surface 112 of the grinding element enclosure 30 adjacent to the ends 29 and 31 of the enclosure 30. In the preferred embodiment, two additional vertical tracks 110 are fixed to the rear surface 95 of the grinding element enclosure 30 adjacent to the ends 29 and 31 of the enclosure 30.

Figure 11:
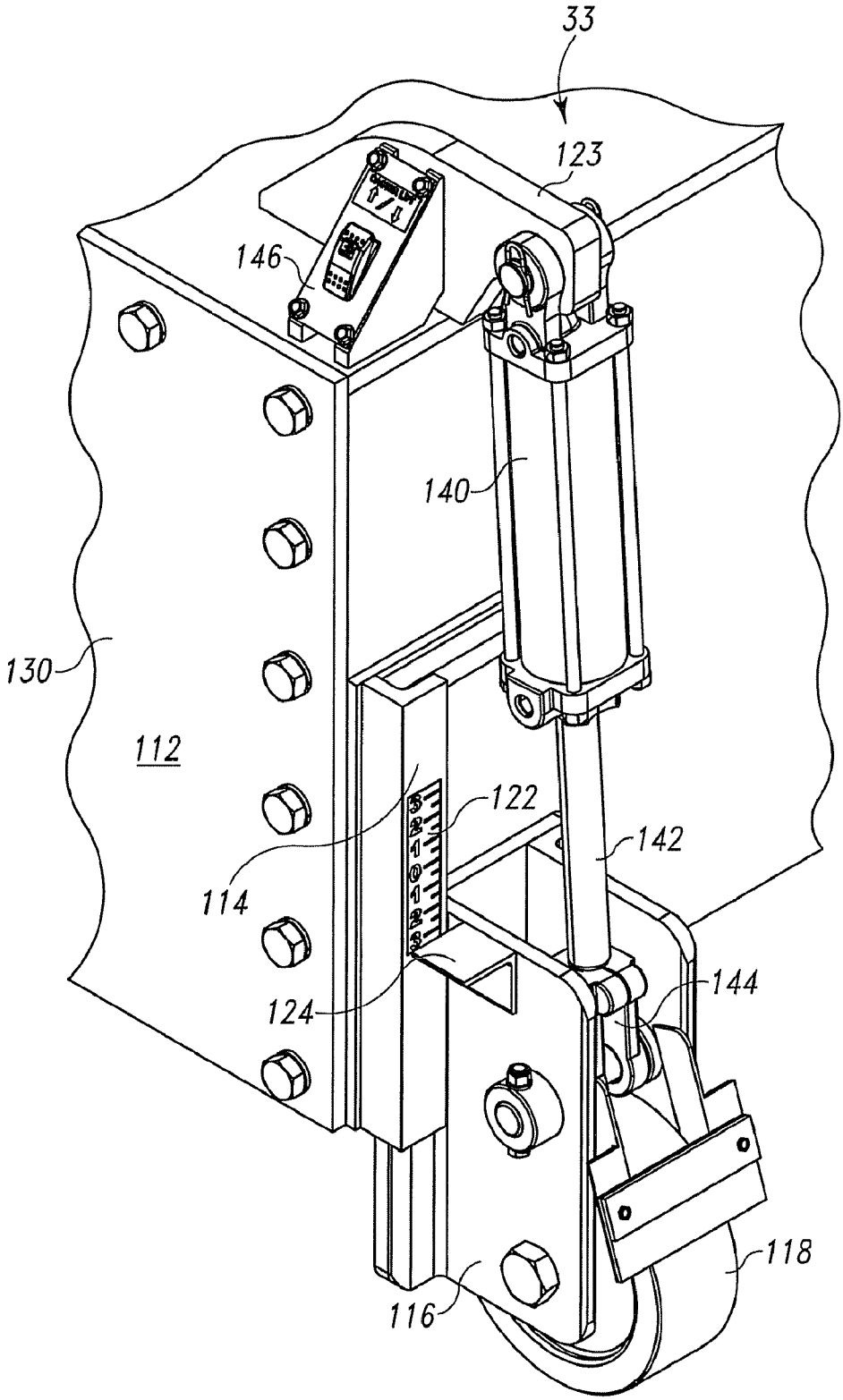
FIG. 11 is a perspective view of another adjustable limiter for limiting the downward movement of the grinding element enclosure relative to the pavement surface.

In an alternative embodiment shown in FIG. 11, the jacking element 120 can be replaced with a hydraulic cylinder 140 and piston 142. The hydraulic cylinder 140 can be coupled to the support 123 fixed to the upper surface 33 of the enclosure 30. A lower end 144 of the piston 142 can be coupled to the wheel carriage 116 so that any movement of the piston 142 relative to the cylinder 140 will be translated to a vertical movement of the wheel carriage 116 relative to the track 110. A controller 146 can be conveniently positioned on the upper surface 33 of the enclosure 30 to facilitate vertical positioning of the wheel carriage 116.

Figure 4:
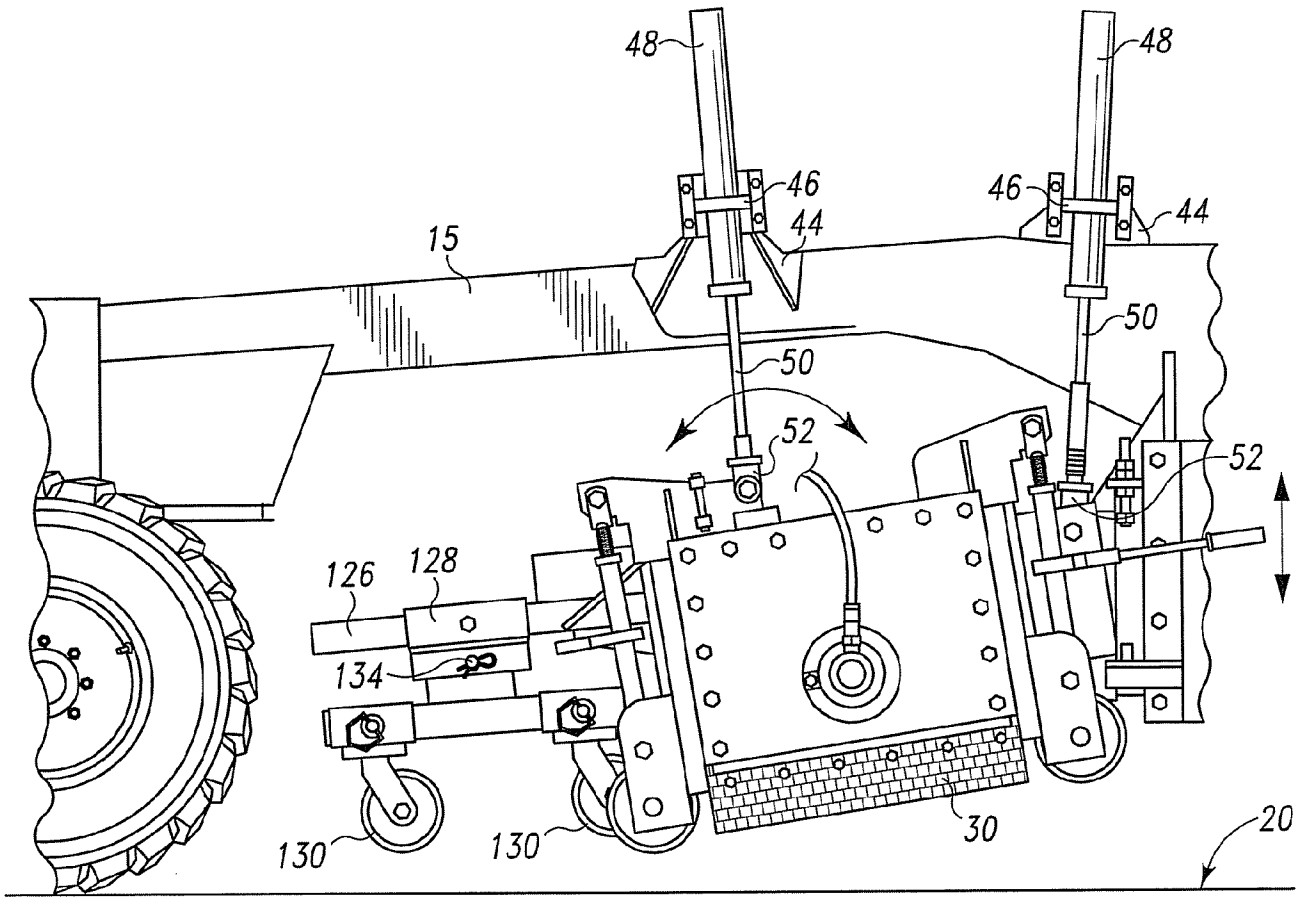
FIG. 4 is a side elevation view of a portion of the road profiler shown in FIG. 1, with the grinding element enclosure positioned vertically at a first position.
Figure 5:
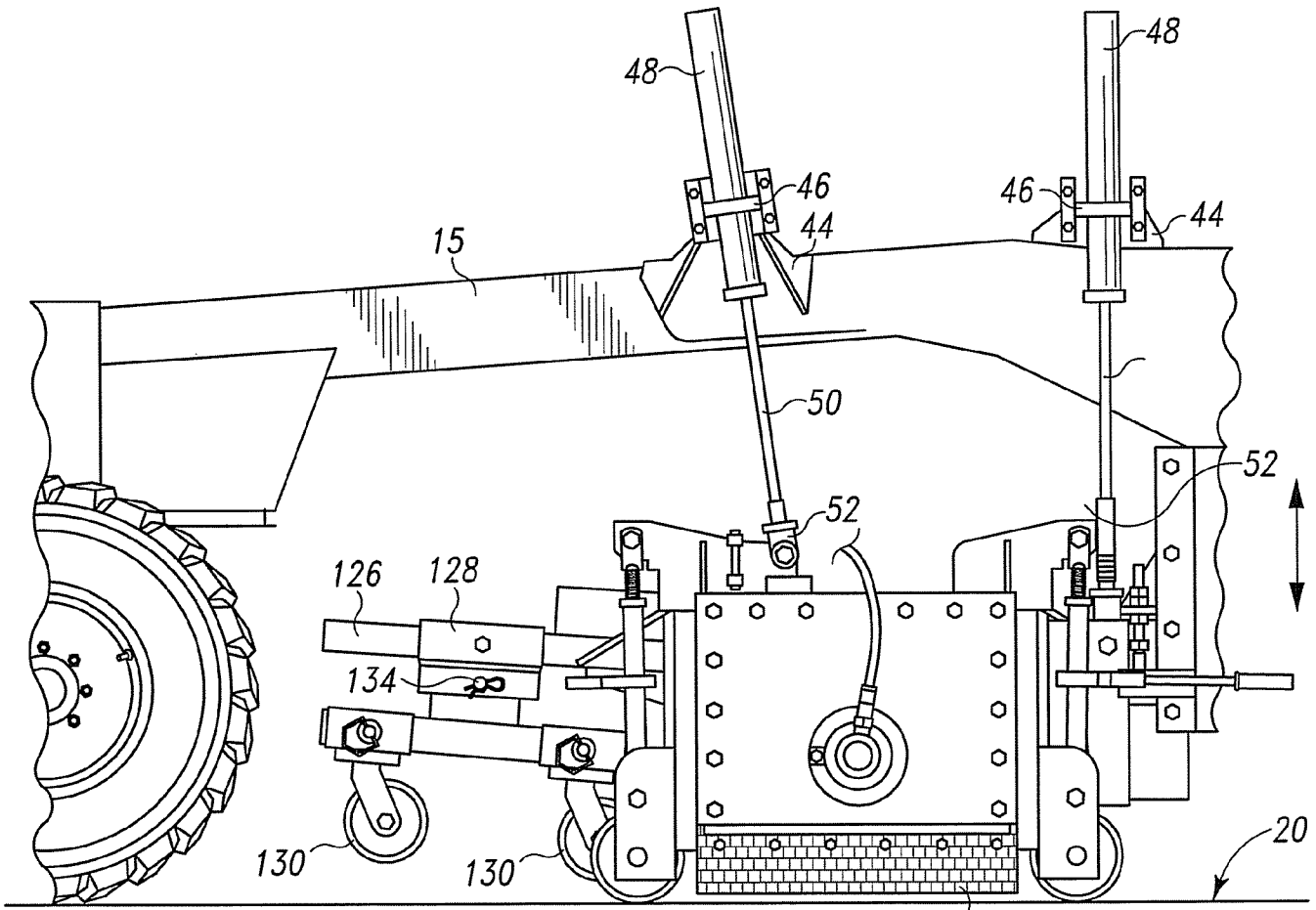
FIG. 5 is a side elevation view of a portion of the road profiler shown in FIG. 1, with the grinding element enclosure positioned vertically at a second position.

A beam 126 can be provided as shown in FIGS. 1, 4 and 5, that projects forward from the grinding element enclosure 30. A floater 128 can be coupled to the beam 126 having two wheels 130 adapted to contact the pavement surface 20. A coupling 132 can be supplied for adjustably coupling the floater 128 to the beam 126 to selectively position the wheels 130 of the floater 128 relative to the open downward facing side 28 of the enclosure 30. The wheels 130 can also be adjustably positioned forward and rearward with respect to each other and with respect to a central pivot point 134 of the floater 128, which can provide for a pitching deflection of the floater 128 relative to the beam 126, to provide the desired about of lead for the profiling operation.

In operation, the primary positioning of the grinding element enclosure 30 is accomplished by selectively locating the front support 36 using the front lift mechanism 38, and by selectively locating the rear support 40 using the real lift mechanism 42. Thus, the profile produced by the grinding element 28 can be based on the long wheel base of the wheels 16 and 18 of the transporter 12. The beam 126 and floater 128 can be used in combination with a selective location of the rear support 40 to shorten the profile base to the distance between the floater 128 and the rear wheels 18 of the transporter 12. The wheels 118 located on the various wheel carriages 116 are generally only used to ensure that the grinding element enclosure 30 is not positioned too low. The enclosure 30 can laterally positioned as desired using the lateral shifting mechanism 108. The enclosure 30 can be centrally positioned with respect to the frame 14 during transport from one job site to another.

While these features have been disclosed in connection with the illustrated preferred embodiment, other embodiments of the invention will be apparent to those skilled in the art that come within the spirit of the invention as defined in the following claims.

What is claimed is:

1. A pavement profiler for modifying a surface of existing pavement comprising:

a transporter having a frame, a forward and a rearward set of wheels supporting the transporter frame above an existing pavement surface, a motor coupled to the wheels for propulsion of the transporter relative to the pavement surface, a grinding element adapted for smoothing the existing pavement surface, an enclosure generally enclosing the grinding element except on a downward facing side confronting the pavement surface, a source of power coupled to the frame for powering the grinding element, and a positioning mechanism coupled between the transporter frame and the grinding element enclosure for positioning the grinding element relative to the pavement surface, the positioning mechanism comprising:

a front support for the enclosure and a front lift mechanism coupled between the transporter frame and the front support for vertically adjusting the position of the front support relative to the transporter frame, a rear support for the enclosure and a rear lift mechanism coupled between the transport frame and the rear support for vertically adjusting the position of the rear support relative to the transporter frame, vertically extending tracks fixed to the transport frame, the rear support including vertically extending rails movable relative to the tracks, the rails being coupled to the rear lift mechanism and, forwardly projecting flanges fixed to the vertically extending rails, each flange having a pivot defining element coupled to the grinding element enclosure to permit the enclosure to pitch relative to the transport frame.

2. The pavement profiler of claim 1, further comprising rearwardly projecting flanges coupled to the grinding element enclosure and situated adjacent to the forwardly projecting flanges, the pivot defining element coupling the forwardly and rearwardly projecting flanges.

3. The pavement profiler of claim 2, further comprising a slot in one of the flanges receiving a pin from an adjacent flange, the slot and pin limiting the range of pitching motion of the grinding element enclosure.

4. The pavement profiler of claim 2, further comprising a lower flange and an upper flange fixed to forward edges of the forwardly projecting flanges, a plate fixed to a rearward surface of the grinding element enclosure, the upper and lower flanges capturing the plate and defining a track for lateral movement of the plate and enclosure relative to the transport frame.

5. The pavement profiler of claim 1, further comprising a first stop coupled to the transporter frame and a second stop coupled to one of the vertically extending rails, one of the first and second stops being adjustable to limit downward movement of the rear support relative to the transporter frame.

6. The pavement profiler of claim 1, further comprising at least one vertical track fixed to a surface of the grinding element enclosure, a wheel coupled to the track adapted for contacting the pavement surface, and a jacking element for adjusting the vertical position of the wheel in relation to said downward facing side of the enclosure to limit downward movement of the enclosure.

7. The pavement profiler of claim 6, wherein the jacking element comprises a hydraulic cylinder and piston.

8. The pavement profiler of claim 1, further comprising a horizontal track fixed to a top surface of the grinding element enclosure, a slide engaged in the track, pivot elements coupled to the slide and to the front lift mechanism, and a lateral shifting mechanism for shifting the horizontal track and enclosure laterally relative to the pivot elements and slide.

9. The pavement profiler of claim 8, wherein the horizontal track comprises a base plate and inwardly directed flanges spaced above the base plate and the slide trapping a forward and a rearward edge of the slide between the flanges and base plate.

10. The pavement profiler of claim 8, wherein the slide comprises a lower plate trapped in the track and an upper plate situated above the track and coupled to the lower plate, the pivot elements being coupled to the upper plate.

11. The pavement profiler of claim 1, further comprising a beam projecting forward from the grinding element enclosure, a floater having two wheels adapted to contact the pavement surface, a coupling for adjustably coupling the floater to the beam to position the wheels relative to the downward facing side of the enclosure.

12. The pavement profiler of claim 1, further comprising pivot elements coupled between transporter frame and the lift mechanisms.

13. A pavement profiler for modifying a surface of existing pavement comprising:

a transporter having a frame, a forward and a rearward set of wheels supporting the transporter frame above an existing pavement surface, a motor coupled to the wheels for propulsion of the transporter relative to the pavement surface, a grinding element adapted for smoothing the existing pavement surface, an enclosure generally enclosing the grinding element except on a downward facing side confronting the pavement surface, a source of power coupled to the frame for powering the grinding element, and a positioning mechanism coupled between the transporter frame and the grinding element enclosure for positioning the grinding element relative to the pavement surface, the positioning mechanism comprising:

a rear support for the enclosure and a rear lift mechanism coupled between the transport frame and the rear support for vertically adjusting the position of the rear support relative to the transporter frame, vertically extending tracks fixed to the transport frame, the rear support including vertically extending rails movable relative to the tracks, the rails including forwardly projecting flanges, a lower flange and an upper flange coupled to forward edges of the forwardly projecting flanges, a plate fixed to the grinding element enclosure, the upper and lower flanges capturing the plate and defining a track for permitting lateral movement of the plate and enclosure relative to the transport frame, and a front support for the enclosure and a front lift mechanism coupled between the transporter frame and the front support for vertically adjusting the position of the front support relative to the transporter frame, the front support having a horizontal track fixed to a top surface of the grinding element enclosure, a slide engaged in the track including pivot elements coupled to the front lift mechanism, and a lateral shifting mechanism for shifting the grinding element enclosure and horizontal track laterally relative to the transporter frame.

14. The pavement profiler of claim 13, further comprising a plurality of vertical tracks fixed to the grinding element enclosure, a wheel coupled to each track adapted for contacting the pavement surface, and jacking elements coupled between the enclosure and each wheel for individually adjusting the vertical position of the wheels in relation to said downward facing side of the enclosure to limit downward movement of the enclosure.

15. The pavement profiler of claim 14, wherein at least one of the vertical tracks is situated on a rearward surface of the grinding element enclosure.

16. The pavement profiler of claim 14, wherein at least one of the vertical tracks is situated on a forward surface of the grinding element enclosure.

17. The pavement profiler of claim 14, wherein at least one of the jacking elements includes a hydraulic cylinder and piston, and a controller situated on the grinding element enclosure adjacent to the hydraulic cylinder.

18. The pavement profiler of claim 13, further comprising a beam projecting forward from the grinding element enclosure, a floater having two wheels adapted to contact the pavement surface, a coupling for adjustably coupling the floater to the beam to position the floater wheels relative to the downward facing side of the enclosure, the coupling including a pivot element allowing a pitching deflection of the floater relative to the beam.

19. A pavement profiler for modifying a surface of existing pavement comprising:

a transporter having a frame, a forward and a rearward set of wheels supporting the transporter frame above an existing pavement surface, a motor coupled to the wheels for propulsion of the transporter relative to the pavement surface, a grinding element adapted for smoothing the existing pavement surface, an enclosure generally enclosing the grinding element except on a downward facing side confronting the pavement surface, a source of power coupled to the frame for powering the grinding element, and a positioning mechanism coupled between the transporter frame and the grinding element enclosure for positioning the grinding element relative to the pavement surface, the positioning mechanism comprising:

a rear support for the enclosure and a rear lift mechanism coupled between the transport frame and the rear support for vertically adjusting the position of the rear support relative to the transporter frame, vertically extending tracks fixed to the transport frame, the rear support including vertically extending rails movable relative to the tracks, the rails including forwardly projecting flanges, a lower flange and an upper flange coupled to forward edges of the forwardly projecting flanges, a plate fixed to the grinding element enclosure, the upper and lower flanges capturing the plate and defining a track for permitting lateral movement of the plate and enclosure relative to the transport frame, a front support for the enclosure and a front lift mechanism coupled between the transporter frame and the front support for vertically adjusting the position of the front support relative to the transporter frame, the front support having a horizontal track fixed to a top surface of the grinding element enclosure, a slide engaged in the track including pivot elements coupled to the front lift mechanism, and a lateral shifting mechanism for shifting the grinding element enclosure and horizontal track laterally relative to the transporter frame, a plurality of vertical tracks fixed to the grinding element enclosure, a wheel coupled to each track adapted for contacting the pavement surface, and jacking elements coupled between the enclosure and each wheel for individually adjusting the vertical position of the wheels in relation to said downward facing side of the enclosure to limit downward movement of the enclosure, and a beam projecting forward from the grinding element enclosure, a floater having two wheels adapted to contact the pavement surface, a coupling for adjustably coupling the floater to the beam to position the floater wheels relative to the downward facing side of the enclosure, the coupling including a pivot element allowing a pitching deflection of the floater relative to the beam.

20. A pavement profiler for modifying a surface of existing pavement comprising:

a transporter having a frame, a forward and a rearward set of wheels supporting the transporter frame above an existing pavement surface, a motor coupled to the wheels for propulsion of the transporter relative to the pavement surface, a grinding element adapted for smoothing the existing pavement surface, an enclosure generally enclosing the grinding element except on a downward facing side confronting the pavement surface, a source of power coupled to the frame for powering the grinding element, and a positioning mechanism coupled between the transporter frame and the grinding element enclosure for positioning the grinding element relative to the pavement surface, the positioning mechanism comprising:

a front support for the enclosure and a front lift mechanism coupled between the transporter frame and the front support for vertically adjusting the position of the front support relative to the transporter frame, a rear support for the enclosure and a rear lift mechanism coupled between the transport frame and the rear support for vertically adjusting the position of the rear support relative to the transporter frame, vertically extending tracks fixed to the transport frame, the rear support including vertically extending rails movable relative to the tracks, the rails being coupled to the rear lift mechanism, and a horizontal track fixed to a top surface of the grinding element enclosure, a slide engaged in the track, pivot elements coupled to the slide and to the front lift mechanism, and a lateral shifting mechanism for shifting the horizontal track and enclosure laterally relative to the pivot elements and slide.

21. The pavement profiler of claim 20, wherein the horizontal track comprises a base plate and inwardly directed flanges spaced above the base plate and the slide trapping a forward and a rearward edge of the slide between the flanges and base plate.

22. The pavement profiler of claim 20, wherein the slide comprises a lower plate trapped in the track and an upper plate situated above the track and coupled to the lower plate, the pivot elements being coupled to the upper plate.

* * * * *